United States Patent [19]

del Valle P. et al.

[11] Patent Number: 4,831,748

[45] Date of Patent: May 23, 1989

[54] APPARATUS FOR DRYING RESINOUS MATERIAL

[75] Inventors: Daniel del Valle P., Agua 413, Mexico 20, D.F., 01900 Mexico City, Mexico; David del Valle Macleod; Deborah del Valle Macleod, both of Mexico City, Mexico

[73] Assignee: Daniel Del Valle P., Mexico City, Mexico

[21] Appl. No.: 95,965

[22] Filed: Sep. 10, 1987

[51] Int. Cl.[4] ..... F26B 11/12

[52] U.S. Cl. ..... 34/181; 34/229; 366/103; 366/300

[58] Field of Search ..... 34/229, 187, 181; 366/102, 103, 104, 297, 298, 299, 300

[56] References Cited

U.S. PATENT DOCUMENTS

| | | | |
|---|---|---|---|
| 1,614,253 | 1/1927 | Nielsen | 34/181 |
| 2,102,255 | 12/1937 | Campbell | 366/300 X |
| 3,632,974 | 1/1972 | Cowlard et al. | 34/166 X |
| 3,678,596 | 7/1972 | Kubo | 34/182 X |
| 3,778,233 | 12/1973 | Blough et al. . | |
| 3,987,021 | 10/1976 | Rothert . | |
| 4,226,973 | 10/1980 | Malo et al. . | |
| 4,234,259 | 11/1980 | Wiedmann et al. | 366/300 X |
| 4,249,828 | 2/1981 | Condolios | 366/102 |
| 4,707,140 | 11/1987 | Mohrlang | 366/300 X |

*Primary Examiner*—Steven E. Warner

[57] ABSTRACT

An apparatus for drying resinous material includes a reaction vessel and a pair of counter-rotating hollow shafts disposed in the vessel. Each of the shafts supports a plurality of blades for stirring the resinous material to be dried in the vessel. A flow of hot gas is continuously supplied through hollow shafts into the blades and released into a reaction vessel through a plurality of apertures in the blades when the blades are in contact with the resinous material.

13 Claims, 4 Drawing Sheets

APPARATUS FOR DRYING RESINOUS MATERIAL

FIELD OF INVENTION

The present invention relates to an apparatus and method for continuous drying of resinous material. It is particularly related to drying apparatus that includes a counter-rotating dual shaft.

BACKGROUND OF THE INVENTION

In the continuous drying of resinous materials, it is important to obtain a high efficiency of the process while at the same time maintaining certain parameters of the drying process at a level which would not adversely affect the quality of the substance being dried. If is especially important to carry out the drying process at temperatures which would not result in degradation of the polymeric materials.

Driers with dual counter-rotating shafts are suggested in the art. For example, U.S. Pat. No. 4,226,973 to Malo, et al. suggests a horizontal, agitated, twin-shaft, jacketed vessel with adjustable paddles mounted on the shafts. Hollow shafts may contain heating elements to provide temperature control. This apparatus can perform drying, crystallization, and solid phase polymerization for upgrading prepolymer particles.

Another example of a drying apparatus with hollow shafts is shown in U.S. Pat. No. 3,678,596 to Kubo for continuous drying of slurry materials. This dryer includes a pair of hollow shafts rotating in predetermined opposite directions and a large number of paddles radially disposed on each shaft and engaging with each other as the two shafts rotate. A horizontal cylindrical vessel surrounds the shaft and jacket. Means are provided for blowing hot gas into the jacket and keeping the material in the co-current or parallel flow through the bulkhead. Also the dryer includes means for combining the co-current of the hot gas exhausted from the holes of the shafts end and openings of the jacket end and means for heating by direct contact with the material in the countercurrent. However, the drying process aimed for in the present invention differs significantly therefrom. For instance, the use of relatively low temperatures is important to the success of the present invention. On the other hand, see the example of Kubo at column 3, line 51, through column 4, line 14, wherein the high temperatures of the inlet gas of 235° C. at the inlet 133° C. at the shaft outlet and 94° C. at the vessel outlet are employed.

SUMMARY OF INVENTION

The advantageous structure of the present invention provides for a high efficiency drying process which allows material to be dried at relatively low temperature in comparison to dryers known in the prior art.

The lower temperature conditions achieved in the present invention are very advantageous since high temperatures contribute to destroying properties within the dried mixture and may result in degradation of the polymeric materials. The conditions for carrying out the drying process in the apparatus of the present invention are possible due to the advantageous structure of the dryer.

The dryer of the present invention includes two counter-rotating hollow shafts which are disposed within a reaction vessel. Each of the shafts includes support means for stirring the resinous material to be dried within the reaction vessel. It also includes means for continuously supplying a flow of hot gas, for example air, into the hollow shaft and means for stirring. The stirring means are provided with means for releasing the flow of the hot gas into the resinous material while the stirring means are in immediate contact with the resinous material to be dried.

Means are also provided to prevent such release of hot gas into the reaction vessel when the stirring means are not in contact with the material being dried. The supply of hot gas through the releasing means at the ends of the stirring means to intermix with the wet polymer facilitates the drying process. Immediate contact of the hot gas with the wet polymeric mixture during counter rotation of the shafts results in a highly efficient drying process at relatively low temperatures.

It is another advantage of the present invention to provide an apparatus of simple and inexpensive structure.

According to one preferred embodiment, the dryer is provided with a plurality of blades which are radially disposed on a pair of hollow shafts to transport and mix the resinous material to be dried in the drying apparatus. The shafts rotate in predetermined opposite directions while the blades cut through the wet polymeric material. Each shaft is disposed within a horizontal cylindrical vessel. Hot gas passes through the hollow shafts and the blades in the direction of the flow of the wet polymers. This type of dryer is capable of continuously drying the wet polymeric materials at relatively low temperatures. The hot gas is released into the material through a plurality of performations at the triangular sections of the blades while they are in contact with the material being mixed and dried.

BEST AND VARIOUS MODES FOR CARRYING OUT INVENTION

Figure 1:
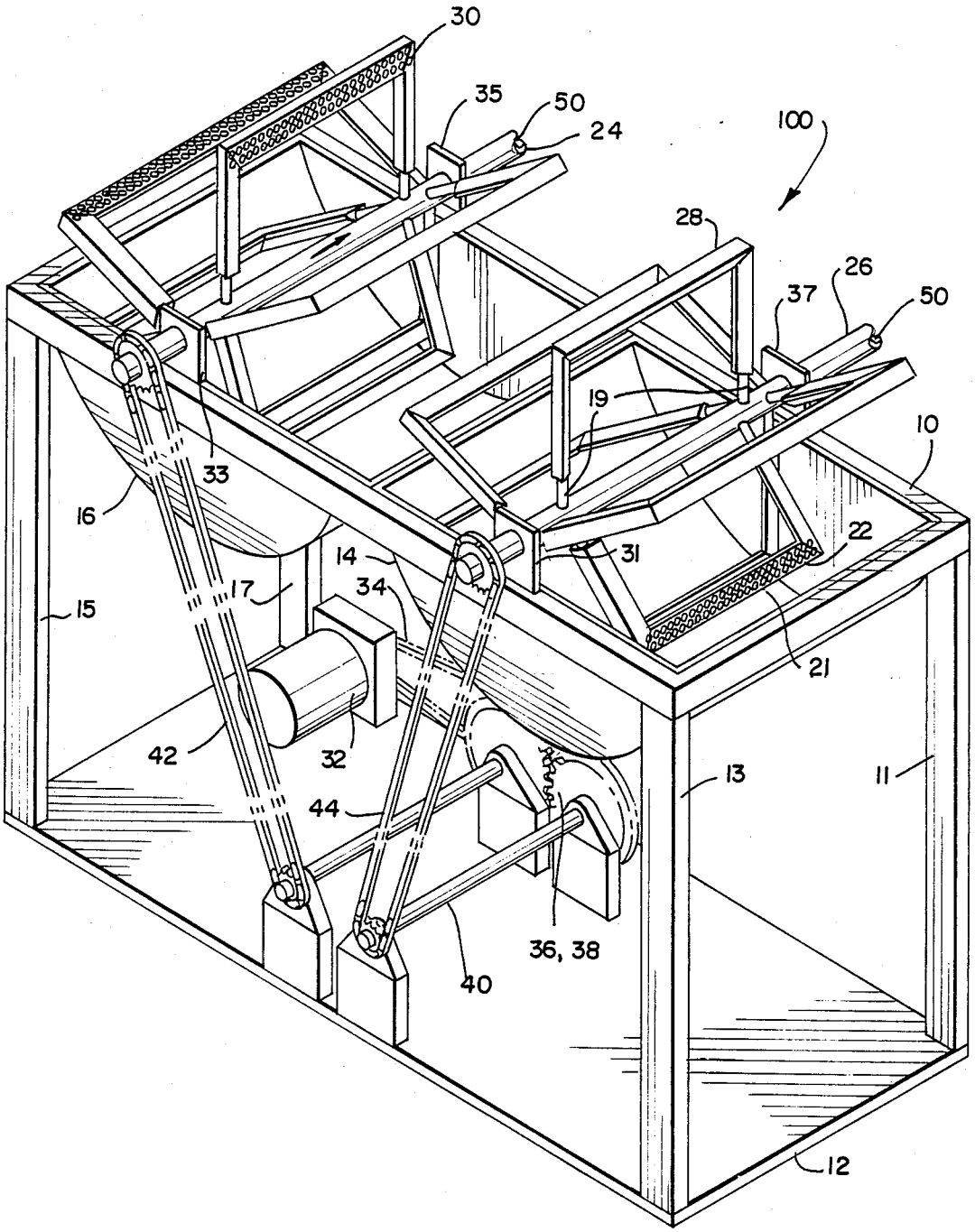
FIG. 1 is a perspective view of the dryer according to the present invention.
Figure 2:
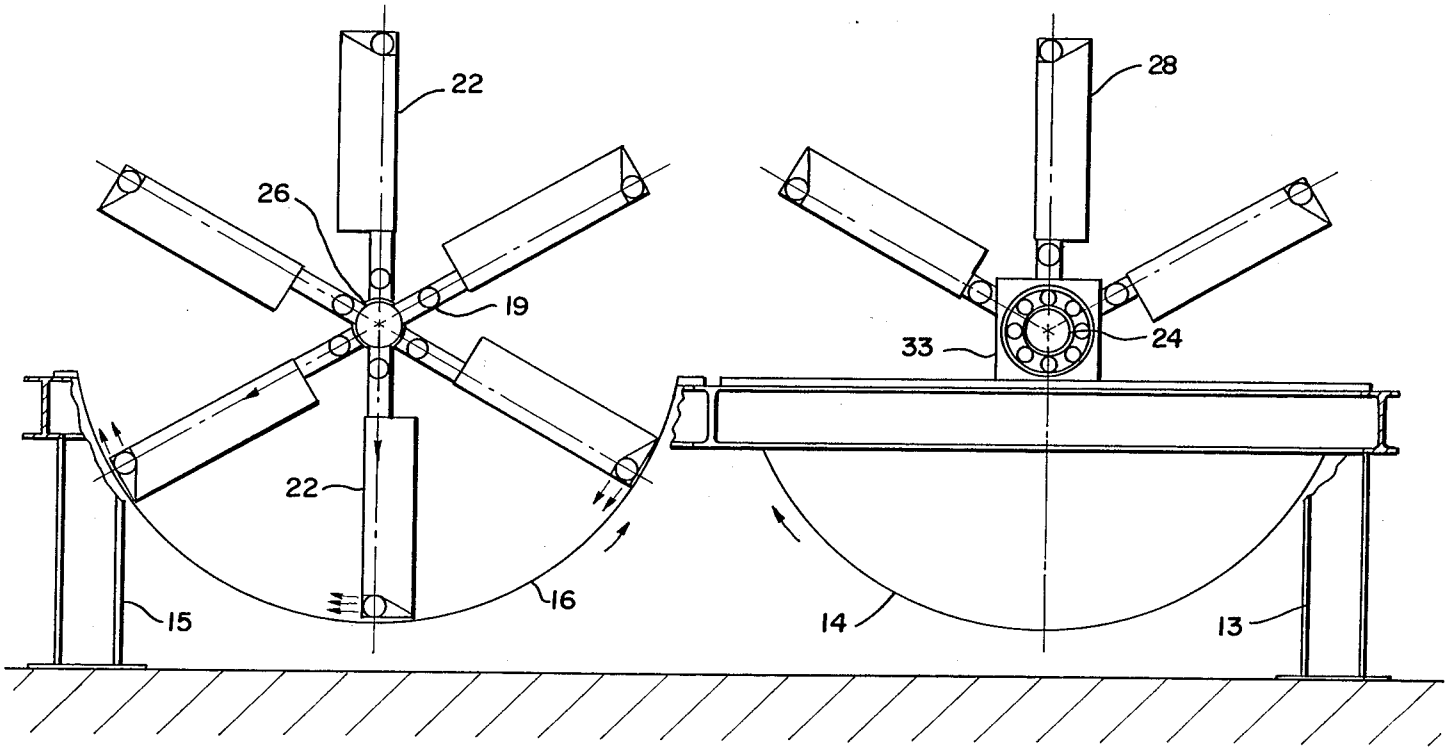
FIG. 2 is a side view showing the dual-shaft with blades mounted thereon.
Figure 3:
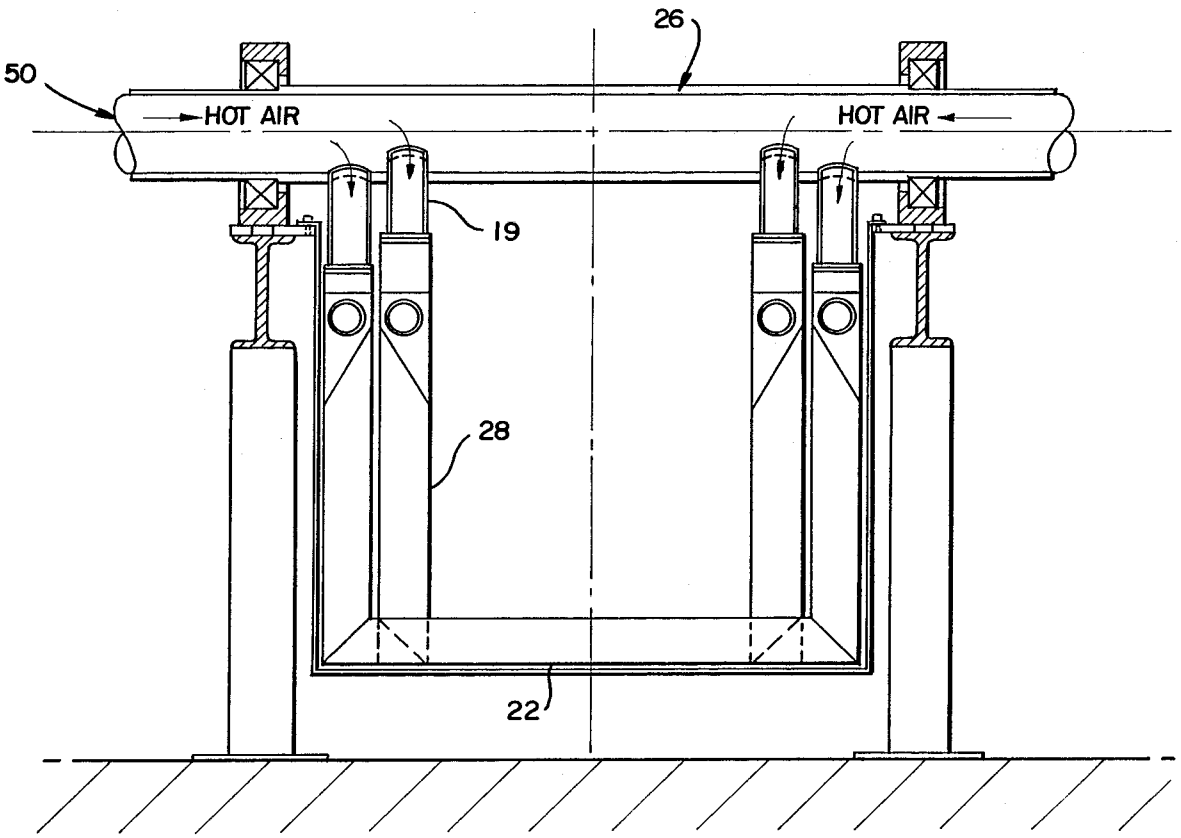
FIG. 3 is a partial view of the shaft with blades indicating hot gas circulation.

As shown in FIGS. 1 and 2, dryer apparatus 100 includes a beam frame 10 which is supported by four legs 11, 13, 15 and 17. The legs are connected to a base portion 12. The beam frame 10 constitutes the upper portion of the supporting structure. Two semi-circular vessels 14,16 are supported at their upper ends along their circumference on the frame 10 and extend downwardly from the frame 10 towards the base portion 12. Two hollow shafts 24 and 26 are mounted on the frame 10 each above the corresponding vessels 14,16 respectively, and are supported by four bearings 31, 33, 35, 37 fixed onto the frame 10. Each shaft is provided with a plurality of blades 28 which are connected by pipes 19 on each side along the length of the shaft. The sets of blades 28 are equally spaced along the circumference of each shaft. In the embodiment illustrated in FIG. 1, each set includes six blades 28 but the number can vary. The blades 28 include triangular bottom portion 22 which is provided with a plurality of apertures 21 which constitute a perforated plate. The two shafts 24, 26 counter-rotate with respect to each other, as shown in FIG. 2, and are driven by means of driving mechanism 50. The driving mechanism includes a motor 32 and a reduction gear box which supplies the torque through a chain drive 34 to the two gears 36, 38. The gears 36, 38 are connected to each of the shafts 24, 26 by suitable chain and sprocket arrangements 42, 44 as shown in FIG. 1. The frame 10 also supports the upper chambers or cages not shown in FIG. 1. The upper chamber encloses the blades as they extend beyond the semi-circular vessels 14,16 and prevent the material being dried from escaping the chambers. The hot gas outlet in the upper chambers is connected to the cyclone to trap the fine particles. Hot gas, for example, air, is blown through the inlets 50 of the hollow shafts 26 and 24 and then passes through connecting pipes 19 and sides of the triangular blades 28. The hot air is released through the back of lower triangular blade portion 22 of the blades 28 which distributes the hot air evenly through the perforated plate apertures 21 in a shower type manner and into the wet polymer material to be dried. The hot air circulation is shown in FIG. 3. Blades 28 move in a circular motion cutting through the wet material to be dried. Because of the circulation effect the pressure on the backside of the blade is lower than on the front side. This condition helps the hot gases to escape through the material being dried. The two sets of blades which are mounted on the two counter-rotating shafts gently mix the material while at the same time released hot air facilitates the drying process. The two shafts rotating counter to each other enable the material not to accumulate on one side of the dryer but rather exchange positions from one tub to the other.

Figure 4:
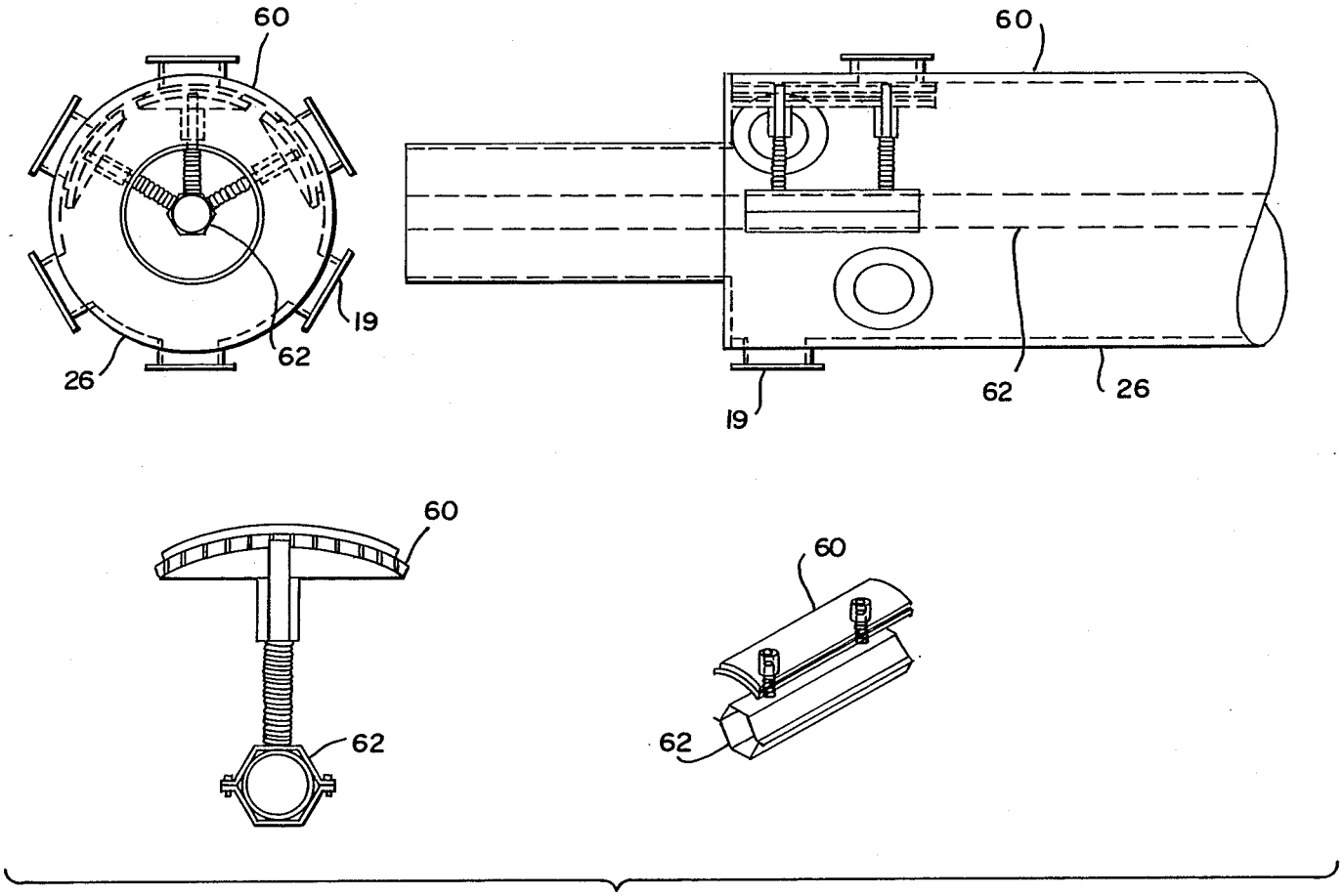
FIG. 4 is a gas supply shoe valve provided within the hollow shafts.

The shafts 24, 26 are provided with shoe valves 60 shown in FIG. 4 which operate to control the release of the hot gases and prevent it from being released when the particular blade on the rotating shaft is not in contact with the material being dried. As shown in FIG. 4 shoe valves 60 are mounted on a fixed through center shaft 62 provided in each of the hollow shafts 24, 26. The shaft 62 holds shoe valves 60 in upright position to block release of hot air when the blade is not in contact with wet polymer. As shown in FIGS. 2 and 4, the hot air is being released through three blades 22 in contact with the material being dried, whereas the other three upper blades are blocked by shoe valves 60. Such structure further contributes to the efficiency of the drying process performed by the apparatus of the present invention. The hot gases proceed to the upper part of the cage or chamber and outlet at the top of the cage and into the cyclone which traps the fines.

In the preferred embodiment of the present invention the tip speed is approximately 1 foot per second. The following examples show the average values of the temperature of a dried mass of resinous materials at a predetermined blade speed of 1 foot per second.

EXAMPLE 1

About 10 kilograms of polyvinyl chloride (PVC) suspension to be used for rigid PVC pipes having the initial water content of 30% is dried in the apparatus as shown in FIGS. 1–4 for about 70 minutes. The final water content is about 0.04%. The initial air inlet temperature is about 101° C. and the initial air outlet temperature is about 30° C. The final air inlet temperature reached about 102° C. and the final air outlet temperature reaches about 43° C. The initial temperature of the mass at the resinous material being dried is about 18° C. and the final temperature of the dried resin is about 30° C. The tip speed of the blades of the rotary shafts is about 1 ft/sec.

EXAMPLE 2

About 15 kilograms of a copolymer of vinyl chloride and vinyl acetate (PVC/PVA) containing about 14% of vinyl acetate to be used for phonograph records having the initial water content of 20% for about 79 minutes to the final water content of 0.5%. Initial air is dried in the apparatus shown in FIGS. 1–4. The inlet temperature is about 96° C. and the initial air outlet temperature is about 34° C. The final air inlet temperature reached about 102° C. and the final air outlet temperature reached about 39° C. The initial temperature of the mass of the resinous material is about 22° C. and the final temperature of the dried mass is again about 32° C. The tip speed of the blade of the rotary shaft is again about 1 ft/sec.

As can be appreciated from these numbers, the temperatures of the resinous materials are relatively low as compared to prior art devices.

While a particular embodiment of the invention has been shown, it should be understood, that the invention is not limited thereto, since modifications may be made, and it is contemplated to cover by the appended claims any such modifications as fall within the spirit and scope of the invention.

We claim:

1. An apparatus for drying resinous material comprising:

a reaction vessel a pair of counter-rotating hollow shafts disposed within said vessel, each of said shafts supporting means for stirring resin to be dried within said reaction vessel, means for supplying a flow of hot air into said hollow shafts and said means for stirring, said means for stirring including a plurality of hollow elongated blades supported along the periphery of each of said shafts, each blade extending substantially parallel to the longitudinal axis of said shaft, each blade being provided with a plurality of means for releasing said flow of the hot air into said resinous material while said blades are in contact with said resinous material to be dried.

2. An apparatus for drying according to claim 1 wherein said reaction vessel comprises a pair of semicircular tubs each housing one of said shafts.

3. An apparatus for drying according to claim 1, wherein said means for releasing comprises a plurality of apertures provided in said blades.

4. An apparatus for drying according to claim 3 wherein said means for releasing comprises perforated plates constituting bottom of said substantially triangular blades.

5. A apparatus for drying according to claim 4 wherein said shafts are provided with valve means for preventing the hot air from being released when said blades are not in contact with said material to be dried.

6. A apparatus for drying acording to claim 4 wherein said valve means are show valves.

7. An apparatus for drying according to claim 1 wherein said elongated blades are substantially triangular.

8. An apparatus according to claim 7, wherein each of said elongated triangular blades is supported at opposite ends by two tubes mounted radially on said hollow shafts and spaced apart along longitudinal axis of said shaft.

9. An apparatus for drying resinous material according to claim 7, wherein said means for releasing comprises a plurality of apertures provided in said blades.

10. An apparatus for drying according to claim 7, wherein said means for releasing comprises perforated plates constituting bottom of said substantially triangular blades.

11. A method for drying resinous material at low temperatures comprising the steps of:

supplying a flow of hot gas into counter-rotating hollow shafts disposed above their corresponding vessels, passing said flow through a stirring means mounted on said shafts, and including elongated hollow triangular blades extending substantially parallel to the longitudinal axis of said shafts and across said material, releasing said hot gas through a plurality of releasing means located on said blades into said material being dried when said stirring means are in contact with said material to be dried.

12. A method for drying resinous material at low temperatures according to claim 11 wherein said hot gas is prevented from being released through said releasing means while not in contact with said material to be dried.

13. An apparatus according to claim 11, wherein each of said elongated triangular blades is supported at opposite ends by two tubes mounted radially on said hollow shaft and spaced apart along longitudinal axis of said shaft.

* * * * *

UNITED STATES PATENT AND TRADEMARK OFFICE

CERTIFICATE OF CORRECTION

PATENT NO. : 4,831,748

DATED : May 23, 1989

INVENTOR(S) : Del Valle P. , Daniel et al

It is certified that error appears in the above-identified patent and that said Letters Patent is hereby corrected as shown below:

Column 4, line 62, change "show" to --shoe--.

Signed and Sealed this

Thirteenth Day of February, 1990

*Attest:*

JEFFREY M. SAMUELS

*Attesting Officer*

*Acting Commissioner of Patents and Trademarks*